US006327803B1

(12) United States Patent
Ruderman

(10) Patent No.: US 6,327,803 B1
(45) Date of Patent: Dec. 11, 2001

(54) BANNER DISPLAY SYSTEM

(76) Inventor: Lawrence Ruderman, 6 Fiddlers Green, Lloyds Neck, NY (US) 11743

( * ) Notice: Subject to any disclaimer, the term of this patent is extended or adjusted under 35 U.S.C. 154(b) by 0 days.

(21) Appl. No.: 09/246,545

(22) Filed: Feb. 8, 1999

Related U.S. Application Data

(63) Continuation-in-part of application No. 08/635,253, filed on Apr. 12, 1996, now Pat. No. 5,870,845.

(51) Int. Cl.[7] ..... G09F 7/00
(52) U.S. Cl. ..... 40/601; 40/617; 160/339
(58) Field of Search ..... 40/470, 601, 617; 160/33, 66, 339, 340, 904; 248/320, 327, 328, 329; 307/150

(56) References Cited

U.S. PATENT DOCUMENTS 662,089 * 11/1900 Pettey ..... 40/617 X
1,340,066 * 5/1920 Lemle ..... 160/331
3,335,511 * 8/1967 Fromme et al. ..... 40/470
4,434,570 * 3/1984 Roos ..... 40/617
4,829,688 * 5/1989 Mouraret et al. ..... 40/601 X
5,529,274 * 6/1996 Anderson et al. ..... 40/601 X
5,870,845 * 2/1999 Ruderman et al. ..... 40/601

FOREIGN PATENT DOCUMENTS

453359 * 10/1991 (EP) ..... 40/601

* cited by examiner

*Primary Examiner*—Brian K. Green
(74) *Attorney, Agent, or Firm*—Andrew C. Aitken; Venable Baetjer Howard & Civiletti LLP

(57) ABSTRACT

A system for raising and lowering an object such as a banner or sign that includes a ceiling unit, that has an axle, and at least two lines connected to the axle in a manner to allow the lines to wind on the axle and thereby moving the object toward and away from the axle. The system has a long control rod having a motor on one end and an engagement to transfer the energy from the motor on the opposite end and thereby controls the rotation of the axle by engaging the ceiling unit and transmitting energy to the axle.

3 Claims, 6 Drawing Sheets

BANNER DISPLAY SYSTEM

RELATED APPLICATIONS

This is a continuation in part of U.S. patent application Ser. No. 08/635,253 filed on Apr. 12, 1996, now U.S. Pat. No. 5,870,845.

BACKGROUND OF THE INVENTION

This invention is for a system used to automatically lower signs such as banners, flags or posters which are suspended from permanent support members. Such signs are increasingly used in connection with interior applications such as retail displays. The signs are typically used to attract and inform shoppers of the presence of particular brands of merchandise offered for sale and also to communicate special pricing terms. Accordingly, it is desirable to be able to mount such signs in such a way that the signs can be removed or replaced quickly and easily. The use of signs which can be easily replaced allows the merchandiser to keep the messages or products which are being advertised current and, thus, allows the merchandiser to quickly accommodate the introduction of new products, styles and promotions. Frequent replacement of signs further informs the customers that new merchandise has been stocked and is available for sale.

In the past, signs which have been used required an installer to climb up on a suitable ladder or lift to initially install and secure hardware for mounting the sign. Whenever the sign had to be replaced, the same procedure was followed. That required the installer to be elevated to or near the ceiling to remove the sign to be replaced and mount the new sign.

The use of mechanized lifts requires a significant capital investment and a suitable location in which to store the lift. Accordingly, most merchandisers use conventional ladders to replace such suspended signs. Using ladders, however, is undesirable because it introduces the possibility of injury to the installer and those in the near vicinity of the operation. Because of the considerable heights of the ceilings from which the signs are suspended, the potential for severe injury is escalated. Many department stores have ceilings which are over 20 feet high and the top of the sign or banner when displayed is often over 15 feet from the floor. The mechanics of changing the sign from a ladder limit operations to those which can be performed within arms length. When a sign is longer than arms length changing the sign may require the involvement of two persons on separate ladders. In the event one person attempts to change the sign, the sign must be temporarily suspended by a single line while the ladder is moved from a first to a second position. Further, balancing on a ladder high above the floor while manually manipulating hardware which secures the sign can be difficult. It is further undesirable to set up ladders during times in which the store is opened to the public. This situation introduces the possibility that the public may interfere with the operation and disrupts normal operations.

The present procedures for removing and replacing signs are inadequate. There is a need for a convenient manner in which to quickly and easily change such signs. The manner should be able to easily conform to existing facilities. Further the manner to access the sign should be convenient to the replacement operation and practical. Lastly, access to the sign should be provided in such a way that unauthorized individuals would not have ready access to the control means so as to prevent vandalism and theft of the signs.

SUMMARY OF THE INVENTION

By the present invention, a system is provided by which signs suspended overhead can be removed and replaced quickly, easily and safely, and without the use of a ladder or mechanized lifts. Furthermore, the system prevents easy access to the suspended signs by vandals or thieves.

In order to achieve these advantages, the system includes a support or ceiling unit attachable to a ceiling for supporting a sign, lines of nylon or the like for suspending the sign below the ceiling unit. The lines are connected to a rotatable shaft in the ceiling unit, which winds and unwinds the lines to raise and lower the signs. A motor is mounted in the ceiling unit and connected to the shaft for rotating the shaft. The system also includes a portable elongate control device operable by a person on the floor to raise and lower signs for removal and replacement. The control device includes a battery for supplying power to the motor in the ceiling unit and an arrangement for conducting power from the battery to the motor. The arrangement includes a telescoping tubular shaft extending between a housing for the battery and a paddle for engaging the ceiling unit for the sign. First electrical contacts are positioned on the paddle, and second electrical contacts are positioned on the exterior of the ceiling unit for the sign so that electric current can flow from the battery, through the extended tubular portion, the first contacts, and the second contacts to the motor in the ceiling unit. A switch is positioned on an end of the control device grasped by a user, and operation of the switch controls the direction of flow of current from the battery to the motor and, thereby, controls the direction of rotation of the motor. Accordingly a reversible electric motor is provided. A brake is provided to prevent the sign from unintentionally lowering under its own weight. Radially extending from the ceiling unit are guide members to guide the contact member of the control device into the proper position on the ceiling unit so that the contacts are in engagement with each other and the paddle disengages the brake the when the paddle of the control device is in engagement with the ceiling unit and the guide. The paddle is shaped to conform to the portion of the ceiling unit around the second contacts to aid in proper engagement of the paddle with the ceiling unit.

DETAILED DESCRIPTION OF THE PREFERRED EMBODIMENT

Figure 1:
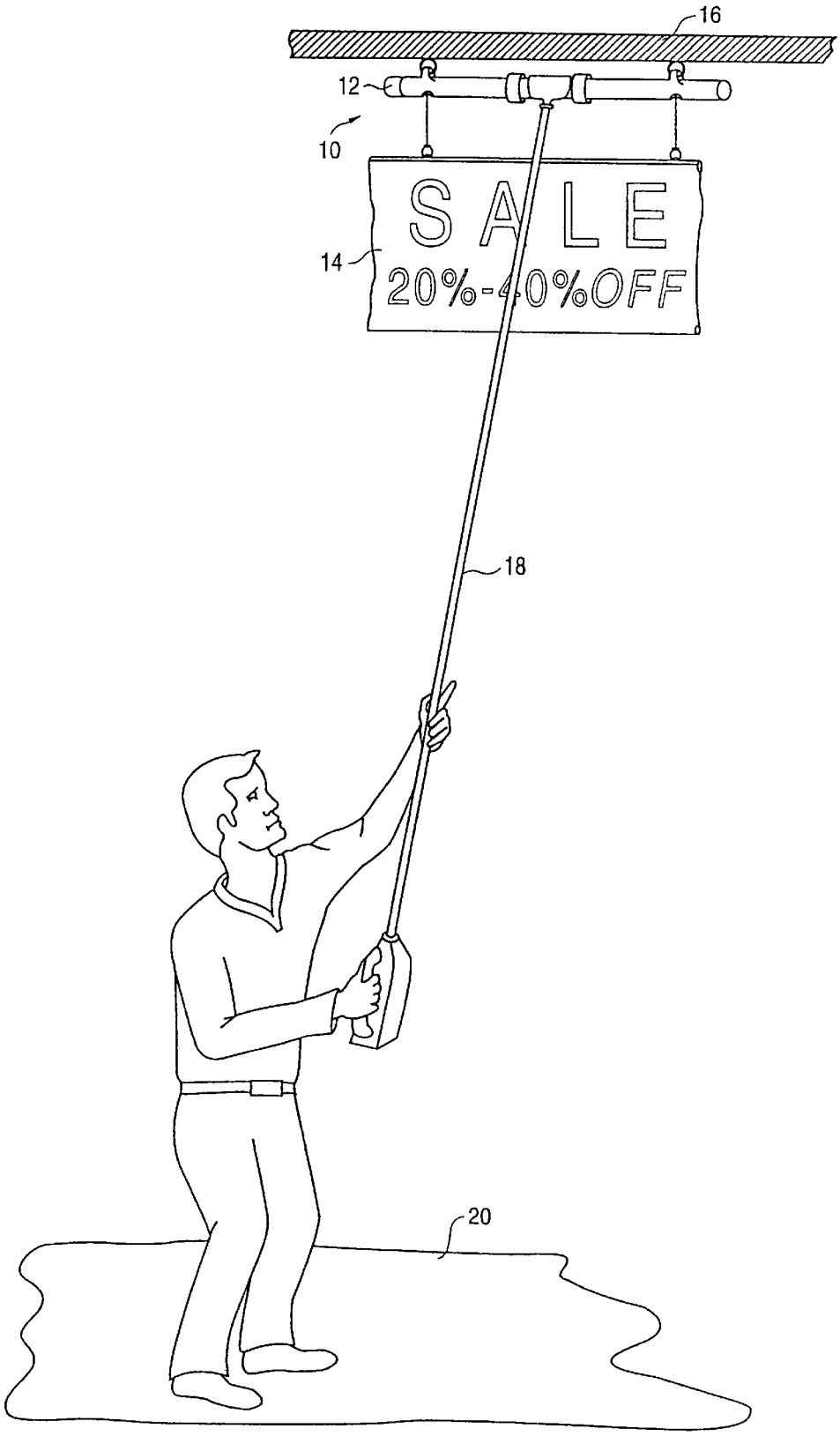
FIG. 1 is a view of the system according to the present invention for raising and lowering signs.

As can be seen from FIG. 1, the sign raising and lowering system according to the present invention, which is designated generally by the reference numeral 10, includes a ceiling unit 12 for suspending a sign or banner 14 from a ceiling 16 and a control device 18 for operating the system from a floor 20.

Figure 2:
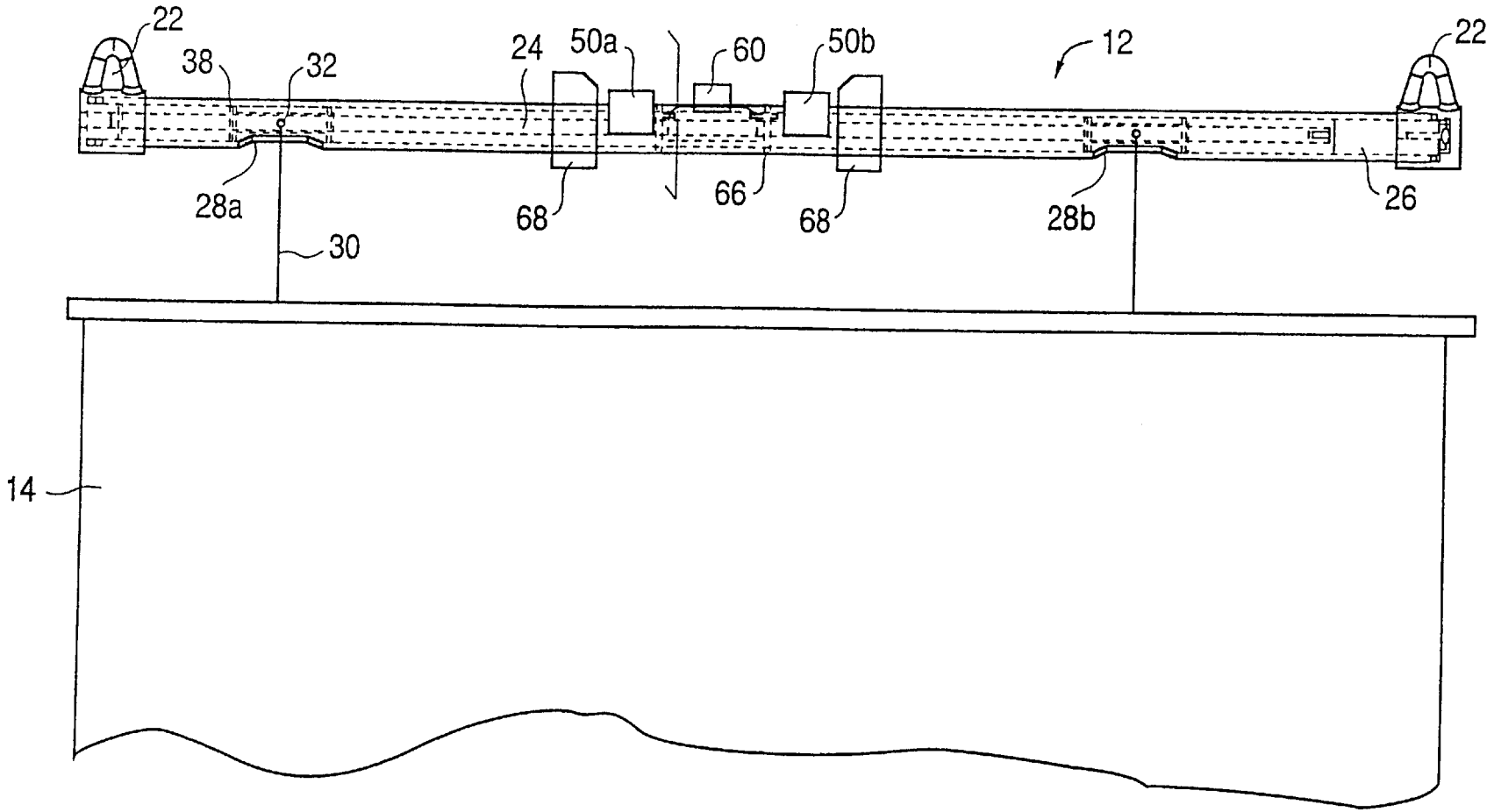
FIG. 2 is an enlarged front view of the ceiling unit of the sign raising and lowering system of FIG. 1.

As can be seen from FIG. 2, the ceiling unit 12 comprises a tubular housing and is oriented horizontally with an eyelet 22 at each end for attachment to the ceiling 16. An elongate shaft 24 is journaled in a conventional arrangement for rotation in the ceiling unit. A reversible motor 26, such as a DC motor, is mounted in the ceiling unit, at one end, and is drivingly connected to elongate shaft 24. Depending on the direction in which current flows through the motor, the shaft 24 rotates in one direction or the other. Openings 28*a* and 28*b* are provided through the ceiling unit cylinder at opposite sides thus providing access to the shaft and which enable lines 30 to pass from the shaft to support the banner. In alignment with the openings in the ceiling unit are through holes 32 provided through the shaft so that line 30, such as a thin line of nylon or other high tensile strength material, can be inserted through the shaft and secured. Upon rotation of the shaft, the lines either wind on the shaft or unwind from the shaft to raise or lower the sign. In an alternate embodiment, instead of securing the lines directly to the rotating shaft, spools 38 can be secured on the rotating shaft in alignment with the openings through the support, so that the lines wind on the spools and unwind therefrom. The use of spools will keep the line as it winds on the shaft in close proximity to the opening in the ceiling unit. Further, the use of spools can serve to increase the radius of the axle which will serve to increase the relative speed at which the sign is lowered or raised.

Figure 3:
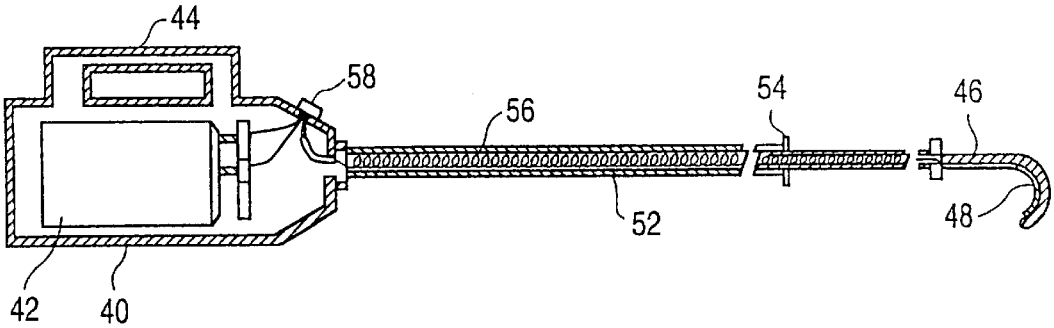
FIG. 3 is a side sectional view of the control device according to the invention.

Referring now to FIG. 3, a housing 40 is included at one end for supporting an electric battery 42, such as a conventional lantern battery. The housing also includes a handle 44 so that the housing may be conveniently held for operation of the system according to the present invention. A curved paddle 46 for engaging the tubular housing of the ceiling unit is positioned at an end of the control device opposite to the housing. The paddle 46 is curved to conform to the curvature of the tubular housing and, thereby, to aid positioning of the control device on the tubular housing while supporting the paddle end of the control device on the ceiling unit 12 for the signs. Electrical contacts 48 in the form of a thin conducting layer are secured on the exterior of the paddle on the inside of the curve defined by the paddle, so that the contacts can engage contacts 50*a* and 50*b* on the exterior of the tubular housing, as will be described hereinafter. The engagement paddle is connected to the housing for the battery by a tubular shaft 52 having individually-locking telescoping sections. Each tubular section can be locked relative to the adjacent section by twisting a locking collar 54 or by other conventional arrangement. The contacts on the engagement panel are electrically connected to the battery by a wire 56, such as a known spiral-coiled wire, which extends through the telescoping sections. The wire is connected at one end to the battery 42 through a switch 58 mounted on the exterior of the housing adjacent to the handle. Switch 58 changes the connections of the positive and negative terminals of the battery relative to the motor in the ceiling unit and, thereby, controls the direction of current flow through the motor and, thus, the direction of rotation of the motor.

Referring back to FIG. 2, a pair of rectangular shaped copper foil contacts 50 are provided on the exterior surface of the ceiling unit on either side of a button 60 of the brake. Connecting the contacts to the motor are copper wires or another suitable conducting material (not shown) which extend down the exterior walls of the ceiling unit. The contacts on the ceiling unit can be engaged by opposite contacts located on the paddle of the control device described above to complete a circuit and activate the motor. To ensure that the contacts 50 of the ceiling unit are properly aligned with the contacts of the paddle and to assist the positioning of the paddle to properly disengage the brake, a pair of guides 68 are provided on the ceiling unit. The guides are particularly useful because the ceiling unit is secured at a considerable height off the floor and accordingly, they facilitate the easy location and engagement of the contacts and brake control by the operator.

Figure 4:
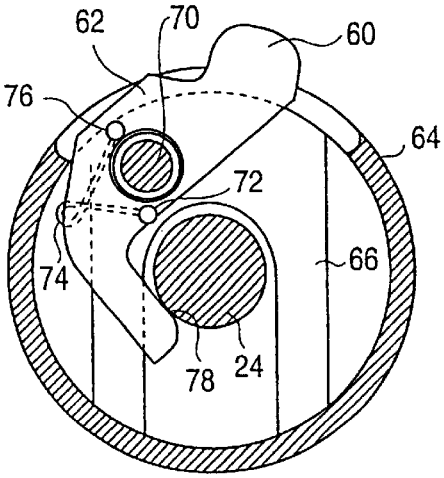
FIG. 4 is a side sectional view of the ceiling unit showing the brake in engagement with the axle.
Figure 5:
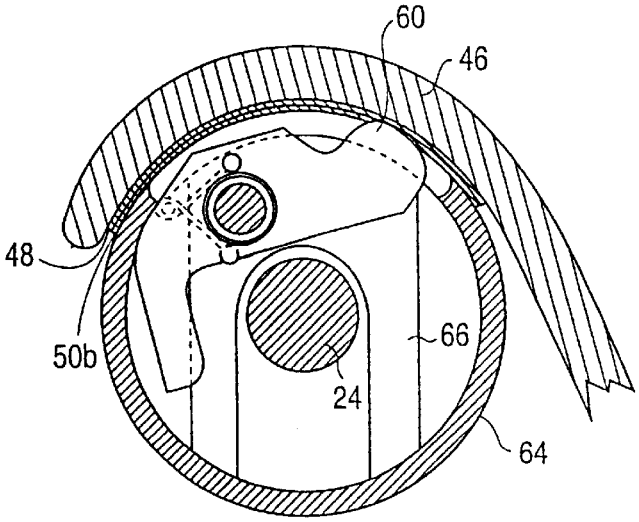
FIG. 5 is a side sectional view of the ceiling unit showing the engagement of the paddle of the control device.

Now referring to FIG. 4, a mechanical brake is shown in engagement with center axle 24. The brake is provided to engage the central axle when the motor is not activated to ensure that the weight of the sign does not pull the sign downward. The brake is generally "L" shaped has an integral button section 60 which is shown extending through and beyond the exterior side wall 64 of the ceiling unit. The lever arm 62 of the brake is pivotally mounted on a support member 66 by a carriage bolt 70. The support member 66 is conformed to fit within the ceiling unit and has an arcuate opening to receive the center axle. Also provided on the support member 66 is a cavity 72 to receive one end of a torsion spring 74. The opposite end of the torsion spring 74 is received in a cavity 76 provided in the brake lever arm 62 and the spring is compressed to biased the lever arm against the axle. Movement of the axle is restricted by frictional engagement wherein surface 78 of the lever arm directly engages the axle. An alternative embodiment using a cam and gear mechanical engagement is also contemplated to lock the axle in place. Because the button section of the brake lever extends beyond the radial sidewalls of the ceiling unit it can be engaged by the paddle of the control device. FIG. 5 shows the paddle 46 of the control device in engagement with the button and the contacts located on the exterior surface of the tubular housing of the ceiling unit and thereby disengaging the brake. Application of force by the paddle 46 to the button 60 section causes the lever arm 62 to pivot around bolt 70 and disengage from the axle. When the button is depressed the axle is thus free to rotate. Also shown in FIG. 5 is the engagement of one of the electrical contacts 50*b* by one of the contacts 48 on the paddle.

In an additional contemplated embodiment of the invention the switch on the control device has a three position switch wherein one position would stop the flow of current from battery to the contacts and therefore the contacts at the paddle would not be live. In this embodiment the other two switch positions would be the same as described above.

When it is desired to remove a sign and replace it with another sign, a system operator takes the control device and extends the telescoping sections a sufficient distance that the engagement paddle can reach the support for the signs. The operator locks the telescoping sections relative to one another as necessary. With the switch in a "lower" position, the operator engages the surface of the paddle on the inside of its curvature with the tubular housing of the ceiling unit so that the contacts on the engagement paddle engage the contacts on the exterior of the tubular housing as depicted in FIG. 5. The operator can take advantage of the engagement of the curving underside of the paddle with the curving exterior surface of the tubular housing to steady the paddle end of the control device. When the contacts on the paddle engage the contacts on the support, the brake is disengaged and the motor begins rotating the shaft to unwind the lines and lower the sign. The sign is lowered to a point at which the operator, while standing on the floor, removes the paddle and can disconnect the lines from the sign. The lines are attached to the sign by any of various conventional arrangements. With the first sign removed, the lines are attached to the replacement sign. The operator then moves the switch to the "RAISE" position and again engages the contacts on the ceiling unit. The current from the battery flows through the reversible motor in the opposite direction from that when the switch is in the "LOWER" position. As a result, the motor rotates the shaft to wind the lines on the shaft and, thereby, raise the sign. When the sign reaches the desired height, the operator removes the engagement paddle from the support.

Figure 6:
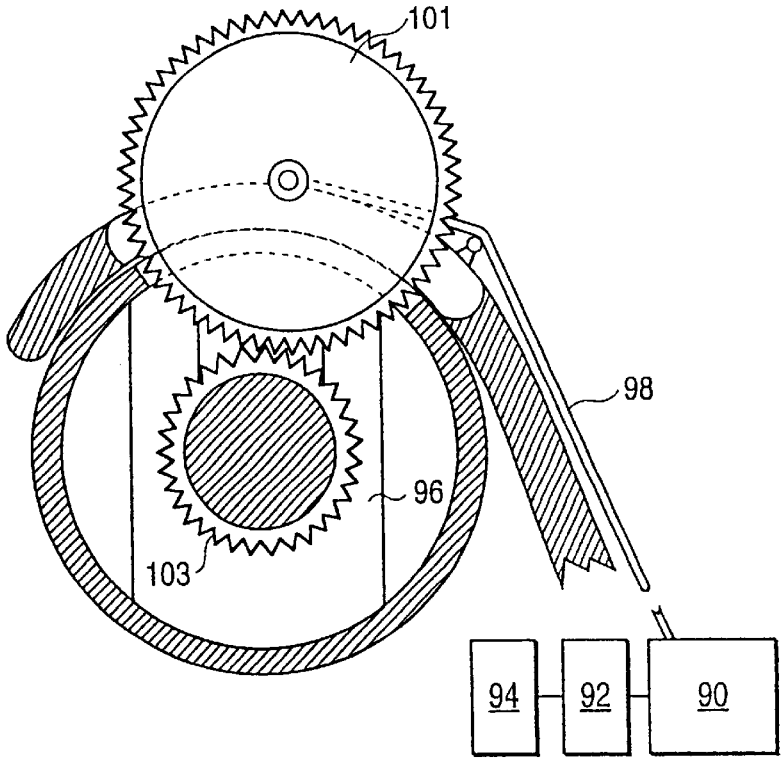
FIG. 6 is a side sectional view of the ceiling unit and paddle according to a second embodiment of the invention.

In a further another contemplated embodiment of the invention, the motor is secured to the control device rather than on the ceiling unit. As shown in FIG. 6 the configuration to apply power to the is schematically represented as a power source 94 which is connected to a switch 92 which is in turn connected to an engine 90. The switch 92 operates to control the direction of engine 90. A drive train 98 in the form of an endless chain is connected to a cog 101 provided on the paddle end of the control device. The cog 101 on the paddle end in turn engages an opposite cog 103 provided on the axle of the ceiling unit. As in the first embodiment, this embodiment requires a braking device to retain the axle in a stationary position at those times the axle is not engaged. In the embodiment represented in FIGS. 6 and 7 it is contemplated that the power source is a battery and the switch is an electric switch which reverses the current provided to the engine 90 which is a direct current reversible motor.

FIG. 6 further shows an axle support member 96 provided within ceiling unit 94 which prevents the axle from sagging in the middle. The axial support member is made to conform to fit within the ceiling unit and has a central channel which receives the axle. The central channel has a smooth receiving surface which is rounded to conform to the axle and allows for free rotation of the axle therein.

Figure 7:
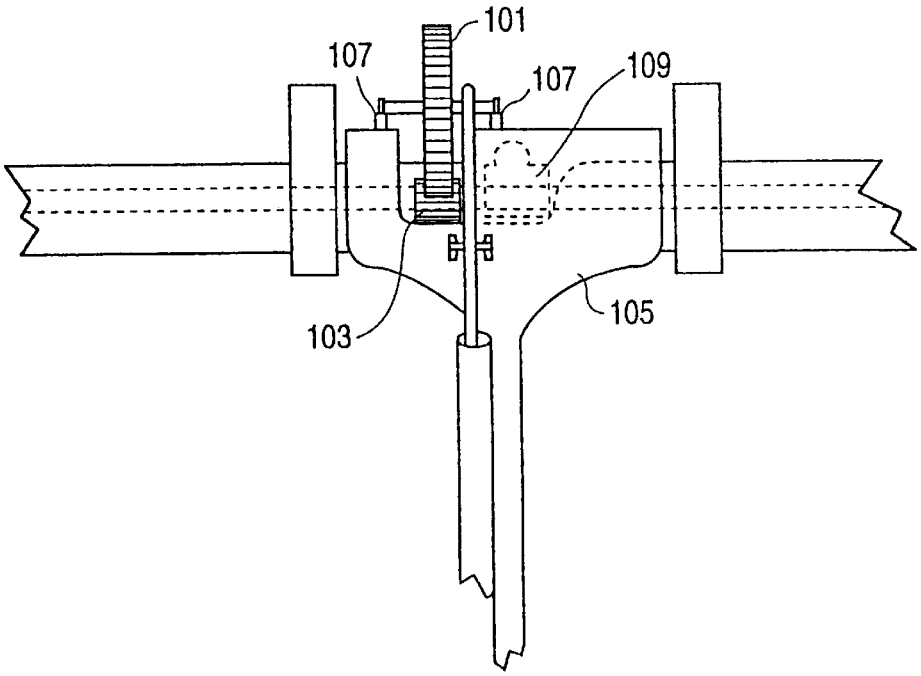
FIG. 7 is a front view in elevation showing a second embodiment of the invention.

As illustrated in FIG. 7 the second embodiment of the invention employs a paddle 105 which is similar to that of the first embodiment with the exception of the slot provided through which cog 101 extends. The cog is mounted on flexible support members 107 which serve to bias cog 101 against cog 103 and thereby ensure good contact. A brake 109 engages the axle to prevent undesired rotation of the axle and concomitant movement of the sign. The brake operates in the same manner as described above in connection with the embodiment shown in FIGS. 1–5.

In further contemplated embodiments, a cog is mechanically driven by a crank rather than an electric motor. For example the engine may be a crank located in a handle section of the control device. A switch is provided to reverse the direction of rotation of the linkage to the driving cog and thereby the sign can be either lowered or raised.

Although the power transfer drive means as depicted in FIGS. 6 and 7 is an endless chain, other drive mechanisms are also contemplated. For example, those ordinarily skilled in the art may select to use an endless belt to drive the cog 101 mounted on the paddle. It is further contemplated that one end of a flexible cable, supported by a rigid rod, could be affixed to the cog and the opposite end be attached to an engine which rotates the cable. Rotation of the cable near the handle would be transferred to the driving cog. Yet a further contemplated embodiment involves the use of ninety degree gearing orientation such as a pinion and bevel gear, skew bevel or worm gear, which would translate the rotational movement of an elongate vertical pole to an intersecting transverse axle on which the driving cog is mounted.

Figure 8:
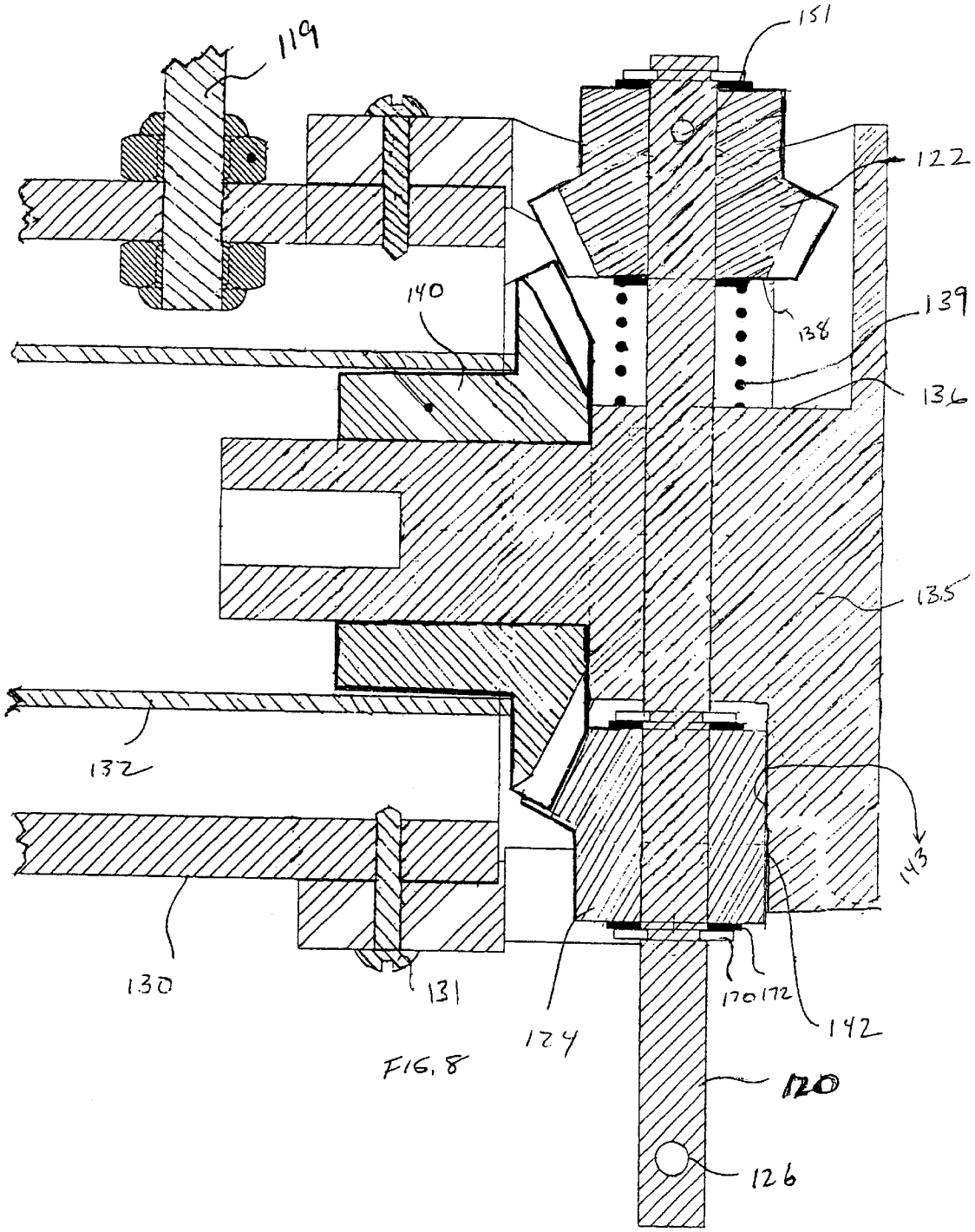
FIG. 8 is a sectional view of one end of a further embodiment of the ceiling unit.
Figure 9:
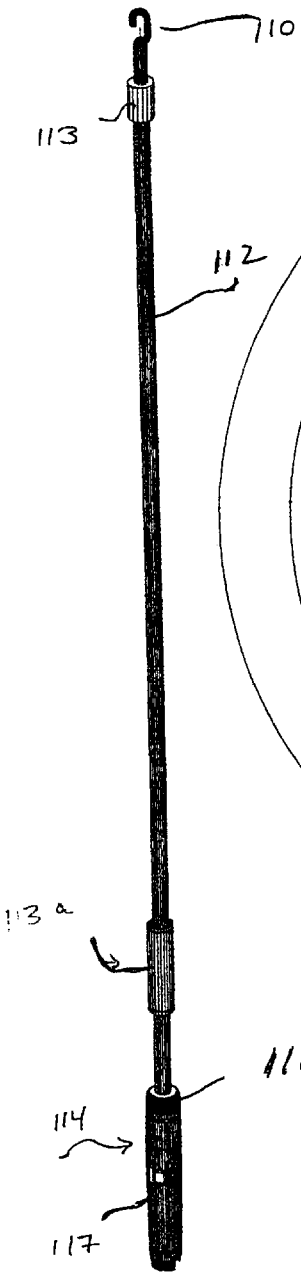
FIG. 9 is a further embodiment of the control rod designed to engage the drive shaft of the ceiling unit depicted in FIG. 8.

FIG. 8 depicts a further alternative embodiment of the invention which uses a ninety degree gear engagement to transfer power from the control rod to the ceiling unit. The embodiment depicted in FIG. 8 is designed to be used in conjunction with the control device depicted in FIG. 9. FIG. 9 shows a control device with a hook 110 at a terminal end of an extended rod 112. Rod 112 is telescopic and its length may be adjusted by the rotation of a frictional collars 113 and 133*a*. On the end opposite the hook of control rod 112 is motor 114 which transfers rotational movement of the motor to control rod 112. In this embodiment a frictional clutch 116 is provided to engage control rod 112 and transfer power from motor 114. The motor is controlled by switch 117 and is reversible. In an alternative contemplated embodiment, a control rod is engaged by a chuck engagement such as that found on conventional power drills. It is thus further contemplated that a control rod can be employed in conjunction with a conventional and commercially available motorized screw drivers or drills. Such devices are presently available in rechargeable battery powered models, which when used in connection with the instant invention further contributes to the convenience for an operator.

Referring now to FIG. 8, one end of a ceiling unit, generally designated by the reference numeral 117, is depicted. The ceiling unit is suspended from a ceiling or other suitable support structure using a bolt 119 and a complementary bolt(not shown) on the opposite end of the ceiling unit. A vertically oriented drive shaft 120 is provided with a beveled drive pinion 122 on one end, and a modified lock pinion 124 which serves to prevent the rotation of horizontal axle 132. The lock pinion 124 is shown in engagement with gear 140 and, in this position, prevents axle 132 from rotation. A through hole 126 is provided through the lower portion of drive shaft 120 which extends downwardly from the end of the ceiling unit casing 130. Vertical drive shaft 120 is journaled through an end cap 135 which also serves as the axis for interior axle 132. Endcap 135 is generally annular shaped and attached to casing 130 by fastener 131. Drive shaft 124 is biased in an upward position by compression spring 139 which is seated against surface 136 of endcap 135 and bottom surface 138 of drive pinion 122. The displacement of drive shaft 120 in a vertical direction is limited by the engagement of lock pinion 124 to the gear 140. Both drive pinion 122 and lock pinion 124 are attached to drive shaft 120 by retention rings. In this regard retention ring 170 and lock washier 172 keeps lock pinion 124 on drive shaft 120. Drive pinion 122 is further attached to drive shaft 126 using a dowel or pin which is passed through passage 151 which transverses both drive shaft 120 and drive pinion 122 and allows the transfer of rotational movement of the drive shaft to drive pinion 122.

Figure 11:
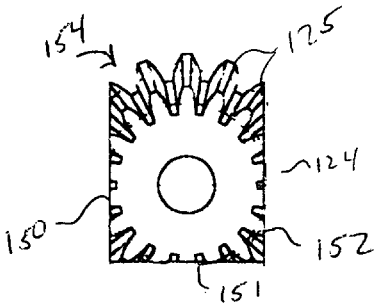
FIG. 11 is a top view of the lock pinion used in connection with the embodiment of the ceiling unit depicted in FIG. 8

FIG. 11 is a top view of the lock pinion showing teeth 125. The sides of a conventional pinion have been modified so the part will fit within a corresponding square groove in the endcap. The use of a lock pinion having a square profile prevents the part from rotation and accordingly, the shaft 132 cannot move when the teeth 125 engage opposite teeth on gear 140.

Figure 10:
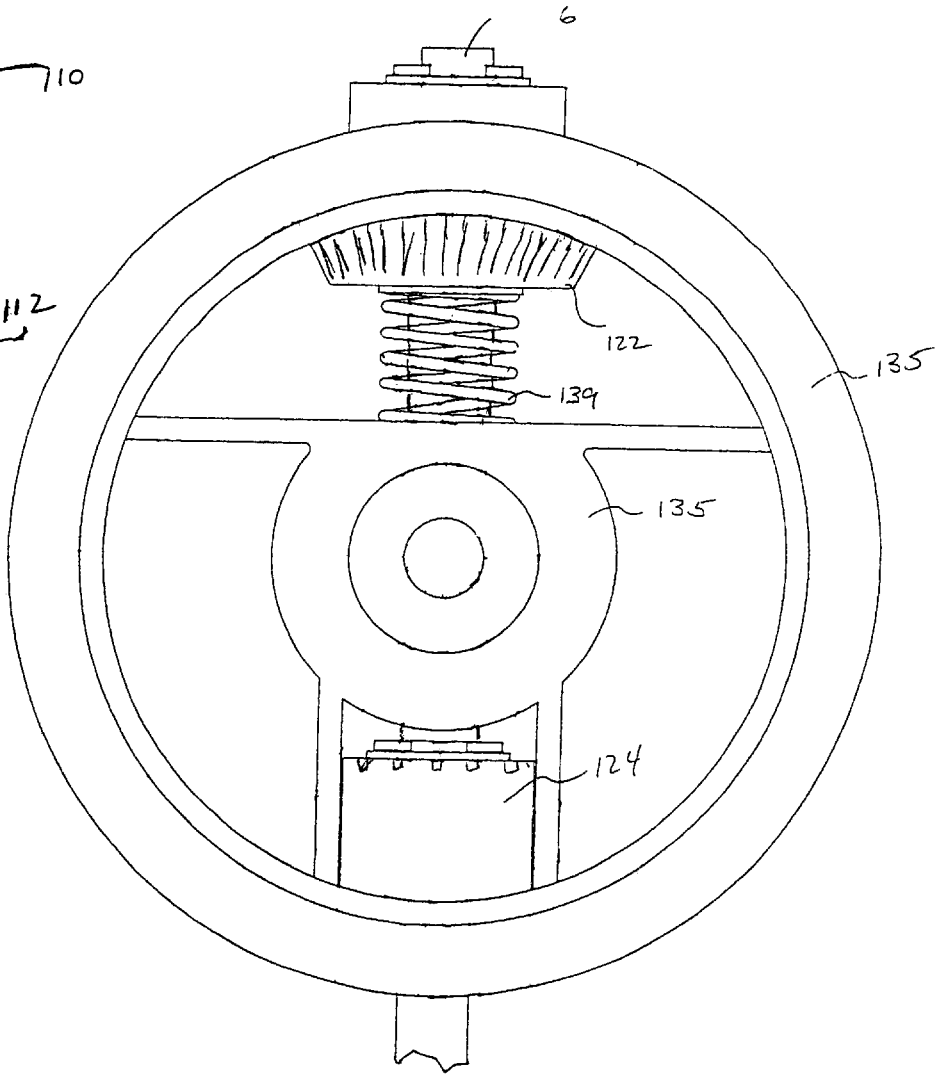
FIG. 10 is an end view of the embodiment of the ceiling unit depicted in FIG. 8.

In operation hook 110 is inserted into through hole 124, and by pulling on the control rod, a downward force is applied to drive shaft 120. The downward force causes spring 139 to be compressed and causes pinion 122 to move downward to engage gear 140. At the same time, lock pinion 124 also moves downward and disengages from gear 140 at the lower section of the drive shaft. As downward force is applied lock pinion 124 is moved down and away from its engagement to gear 140. As best seen in FIG. 10, lock pinion

124 has three flat lateral surfaces 150, 151 and 152 and a fourth side 154 having an arcuate surface on which are provided teeth 125 which can mesh into opposite teeth provided on gear 140. When the lock pinion is received within the endcap the lateral sides engage opposite surfaces provided in the endcap which prevents the lock pinion from turning. When the lock pinion's teeth 124 engage the opposite teeth of gear 140 the gear is likewise prevented from turning and, accordingly the axle is maintained in a stationary position.

While the application of downward force is maintained on hook 110, motor 114 is activated causing rotation of the rod 112 and hook 110. Rotation of hook 110 causes the drive shaft 120 and drive pinion 122 to rotate. The rotational movement of drive pinion 122 is translated to gear 140 which drives axle 132 within the ceiling unit. As described in the previous embodiments, lines are attached to a sign or banner and to axle 132. As the axle is turned, the lines are spooled on or off to respectively raise or lower the sign. When the downward force is released from hook 110, compression spring 139 will bias pinion 122 upward and away from the gear 140 and cause the lock pinion 124 to raise and engage gear 140 preventing rotational movement of the roller.

FIG. 9 depicts a control rod having a hook at the end which is designed to engage a passage through the spring loaded, vertical oriented drive shaft 120. In an alternative embodiment a rod is provided with an end which can be engaged by conventional cordless drills.

It will be apparent to those skilled in the art and it is contemplated that variations and/or changes in the embodiments illustrated and described herein may be made without departure from the present invention. Accordingly, it is intended that the foregoing description is illustrative only, not limiting, and that the true spirit and scope of the present invention will be determined by the appended claims.

What is claimed is:

1. A system for raising and lowering an object, comprising a ceiling unit, said ceiling unit comprising an axle, and at least two lines connected to said axle in a manner to allow said lines to wind on said axle to moving an object toward and away from said axle, said system further comprising means to rotate the axle;

means to control the rotation of said axle, said means to control the rotation of said axle comprising an elongate rigid control rod, said elongate rigid control rod having a removably engageable energy transfer means on a first end wherein when said object is raised or lowered said rod is engaged to said ceiling unit and wherein said control rod further comprises a motor on an end opposite said first end and said energy transfer means comprises a hook whereby said motor causes said rod and said hook to rotate and said rotational movement is translated to said axle.

2. The system recited in claim 1 further comprising braking means and said braking means comprises a spring biased lock pinion which engages gears connected to said axle.

3. The system as recited in claim 1 wherein said control rod further comprises a battery.

* * * * *